US008480256B2

(12) United States Patent
Hollinger

(10) Patent No.: US 8,480,256 B2
(45) Date of Patent: Jul. 9, 2013

(54) XTREE SYSTEMS

(76) Inventor: Kathleen Hollinger, Lancaster, PA (US)

( * ) Notice: Subject to any disclaimer, the term of this patent is extended or adjusted under 35 U.S.C. 154(b) by 278 days.

(21) Appl. No.: 12/897,565

(22) Filed: Oct. 4, 2010

(65) Prior Publication Data

US 2011/0122624 A1 May 26, 2011

Related U.S. Application Data

(60) Provisional application No. 61/262,948, filed on Nov. 20, 2009.

(51) Int. Cl.
*F21S 4/00* (2006.01)
*F21V 21/092* (2006.01)
*A47G 33/10* (2006.01)

(52) U.S. Cl.
USPC ..... 362/249.19; 362/123; 362/397; 428/8

(58) Field of Classification Search
USPC ..... 362/123, 249.18, 249.19, 397, 806, 362/808; 428/7–9, 18–20
See application file for complete search history.

(56) References Cited

U.S. PATENT DOCUMENTS 1,577,207 A * 3/1926 Dieperink-Langereis ..... 428/8
3,027,671 A * 4/1962 Duvall ..... 428/8
3,463,918 A * 8/1969 Franc ..... 362/123
3,532,874 A * 10/1970 Rosenast ..... 362/567
3,581,419 A * 6/1971 McCracken ..... 428/18
3,641,335 A * 2/1972 Wall ..... 362/567
3,857,748 A 12/1974 Thomann
4,144,364 A * 3/1979 Tice ..... 428/9
4,468,421 A 8/1984 Wang
4,612,218 A 9/1986 Enterline
5,639,157 A * 6/1997 Yeh ..... 362/567
5,939,154 A 8/1999 Gonzalez
5,971,172 A 10/1999 Cockerham
6,017,142 A * 1/2000 Harris, Jr. ..... 362/564
6,057,010 A 5/2000 Ayers
6,139,168 A * 10/2000 Gary et al. ..... 362/249.19
6,818,264 B1 * 11/2004 Samperisi, Jr. ..... 428/20
7,198,383 B2 * 4/2007 Martino ..... 362/249.06
7,211,305 B2 * 5/2007 Steiger et al. ..... 428/7

* cited by examiner

*Primary Examiner* — Alan Cariaso
(74) *Attorney, Agent, or Firm* — RG Patent Consulting LLC; Rachel Gilboy

(57) ABSTRACT

A wall-mounted Christmas tree device serving as a festive holiday decoration that takes up minimal space. This pine tree-shaped invention may be temporarily removably mounted to at least one wall and/or door or other suitable vertical surface thereby making it easy for occupants of virtually any size residence to display a beautiful, realistic festive decoration. The wall-mounted Christmas tree device disclosed herein preferably comprises the following components: at least two flat tree half outlines; a spine having a plurality of sockets; a base having electrical powering means; and a plurality of insertable branches. The Styrofoam or fiberglass flat tree half outlines may include double-sided tape or a plurality of suction cups to removably attach the wall-mounted Christmas tree device on a vertical surface. A kit for the present invention and method of use is also described herein.

4 Claims, 4 Drawing Sheets

XTREE SYSTEMS

CROSS-REFERENCE TO RELATED APPLICATION

The present application is related to and claims priority from prior provisional application Ser. No. 61/262,948, filed Nov. 20, 2009 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

The present invention relates generally to the field of holiday ornaments and more specifically relates to a wall-mounted Christmas tree device 2. Description of the Related Art The Christmas tree is a decorated evergreen coniferous tree, real or artificial, and a tradition associated with the celebration of Christmas, or originally Yule. The Christmas tree is often brought into a home, but may also be used in the open, and may be decorated with Christmas lights, ornaments, garlands and tinsel during the days around Christmas. An angel or star is often placed at the top of the tree, representing the host of angels or the Star of Bethlehem from the Nativity.

A significant amount of individuals, families and businesses celebrate the Christmas holiday by putting up a real or artificial tree that they decorate and put gifts under. Both artificial and real trees are typically floor mounted. Unfortunately, not every consumer who would like to have a tree for festive decoration has the room to house a full-sized tree often due to spatial restraints.

One drawback of artificial trees for user's who may want to eliminate the maintenance that comes with having a real tree, is the difficult assembling and breakdown due to their bulky nature and large storage space required to store these trees. Further, the breakdown of artificial trees may become a tedious task and the bulky parts may be inconvenient to handle. When the season approaches to assemble the Christmas tree, furniture typically needs to be rearranged in order to provide space for the artificial or real Christmas tree. This rearrangement of furniture may lead to undesirable temporary storage of this furniture just to make adequate room for the tree. In order to solve this problem, a variety of Christmas trees have been created.

One such Christmas tree is the table-mounted tree to accommodate user's without adequate floor space. This smaller table-mounted versions may not provide users the ambiance of what a full-sized floor mounted tree brings along with often being too small to decorate with items such as lights, ornaments, ribbon, or candy. Therefore, there is a need for a folding artificial Christmas tree frame which may be mounted on a vertical structure, such as a wall, adorned with a wide variety of decorations, and folded for easy storage.

Various solutions have been proposed for the aforementioned problems such as those found in U.S. Pat. Nos. 5,971, 172, 3,857,748, 5,939,154, 6,057,010, 4,612,218, 4,468,421. Although these patents address some of the problems stated previously, they fail to provide a wall-mounted Christmas tree device that is space-saving, yet still resembles a 3-dimension Christmas tree, while still permitting a user to adorn the tree with decorations such as lights, ornaments, ribbons, or candy, and is compact when un-assembled for storage.

Ideally, an X-tree system for wall-mounting a Christmas tree should be space-saving, 3-dimensional to resemble an actual Christmas tree, be large enough to adorn with decorations, be safe in use, user-friendly, and can be manufactured at a modest expense. Further, the Xtree system should be aesthetically pleasing to provide the desirable ambience. Thus, a need exists for an Xtree system to avoid the above-mentioned problems.

BRIEF SUMMARY OF THE INVENTION

In view of the foregoing disadvantages inherent in the known Christmas tree ornaments and devices art, the present invention provides a novel Xtree system for wall-mounting a Christmas tree device comprising a festive holiday decoration is spacitially efficient in use. This pine tree-shaped invention may be temporarily removably mounted to at least one wall and/or door (or other substantially vertical surface) thereby making it easy for occupants of virtually any size residence to display a beautiful festive decoration.

The present wall-mounted Christmas tree device disclosed herein preferably comprises the following components: at least two flat tree half outlines; a spine having a plurality of sockets; a base having electrical powering means; and a plurality of insertable branches. The two Styrofoam or fiberglass flat tree half outlines include double-sided tape or a plurality of suction cups to removably attach the wall-mounted Christmas tree device on a vertical surface such as a door, window, wall or other like surface.

The plastic spine has a hollow inner volume with a plurality of sockets, and a top-mounted removably couplable decorative adornment. The base has electrical powering means comprising a DC power source including at least one battery. Further the base may comprise an AC power source. The base further includes a computing housing means suitable for controlling lighting patterns and music, and a front-access panel allowing users to select said lighting patterns and said music. The plurality of insertable branches may have computer-controlled light-emitting diodes and pre-fitted decorations including ornaments, ribbons, bells, and/or candy.

To assemble the wall-mounted Christmas tree device, the two flat tree half outlines are removably insertable into the sockets of the spine to form a frame for the wall-mounted Christmas tree device. The spine is removably coupleable to the base to power the wall-mounted Christmas tree device. The plurality of branches are removably insertable and arrangeable in the sockets in the spine for a 3-dimensional effect thereby providing a wall-mountable ornamental holiday decoration.

A kit is embodied herein for the Xtree system comprising at least two flat tree half outlines; at least one spine having a plurality of sockets; at least one decorative adornment; a base having electrical powering means; a plurality of insertable branches; attaching means; and a set of user instructions.

In accordance with the embodiments of the present invention a preferred method of use is disclosed herein comprising: step one mounting at least one spine (having a plurality of sockets) onto a vertical surface; step two inserting at least two flat tree half outlines into the plurality of sockets; step three inserting a decorative ornament into the plurality of sockets on a top portion of the spine; step four inserting a base having electrical powering means to the plurality of sockets on the spine; and step five inserting a plurality of insertable branches into the plurality of sockets on the spine for a 3-dimensional effect thereby providing a ornamental holiday decoration.

The present invention holds significant improvements and serves as an Xtree system. These and other features, aspects, and advantages of the present invention will become better understood with reference to the following drawings and description.

BRIEF DESCRIPTION OF THE DRAWINGS

The figures which accompany the written portion of this specification illustrate embodiments and method(s) of use for the present invention, Xtree systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to Christmas tree ornaments and devices and more particularly to Xtree system 100 as used to display wall-mounted Christmas tree device 102 for a 3-dimensional effect.

Figure 1:
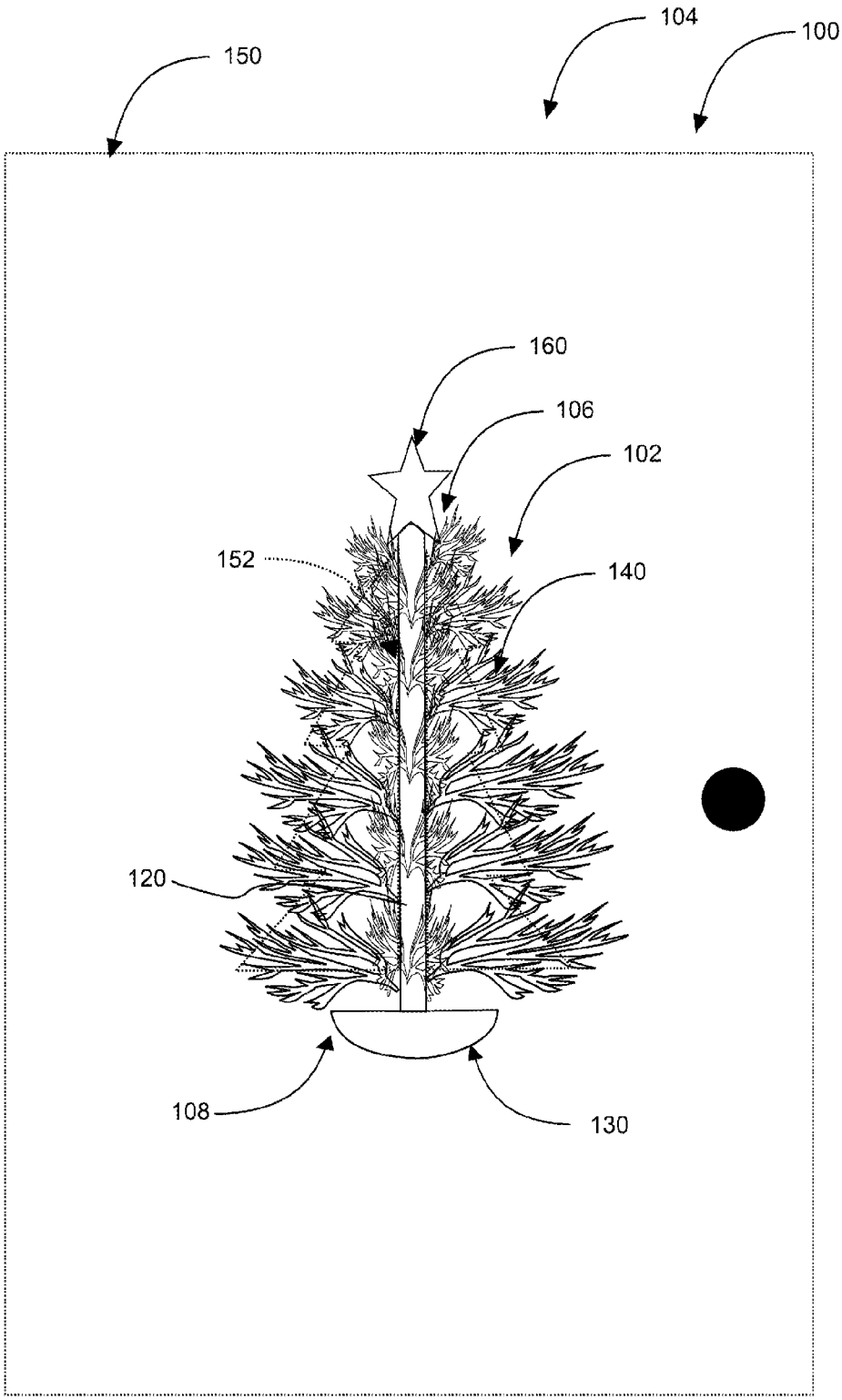
FIG. 1 shows a perspective view illustrating an Xtree system in an 'in-use' condition according to an embodiment of the present invention.

Referring to the drawings by numerals of reference there is shown in FIG. 1, a perspective view illustrating xtree systems 100 in an 'in-use' condition 104 according to an embodiment of the present invention. Xtree system 100 includes wall-mounted Christmas tree device 102 to provide at least one user with a beautiful holiday decoration that preferably requires very minimal floor space. Wall-mounted Christmas tree device 102 may be triangular shaped, preferably having narrow apex 106 at the top and broadening out to form wider foundation 108. Xtree wall-mounted Christmas tree device 102 is preferably lightweight and designed to be realistic looking to provide the desired ambience. Wall-mounted Christmas tree device 102 is preferably mountable to a vertical surface 150 to minimize the space required to display this ornamental holiday decoration. Xtree system 100 is ideal for users who may prefer wall-mounted Christmas tree device 102 in their homes, offices, schools, hospitals, and retirement homes where space restriction(s) play a vital role in the type and size of holiday decorations that may be displayed.

Figure 2:
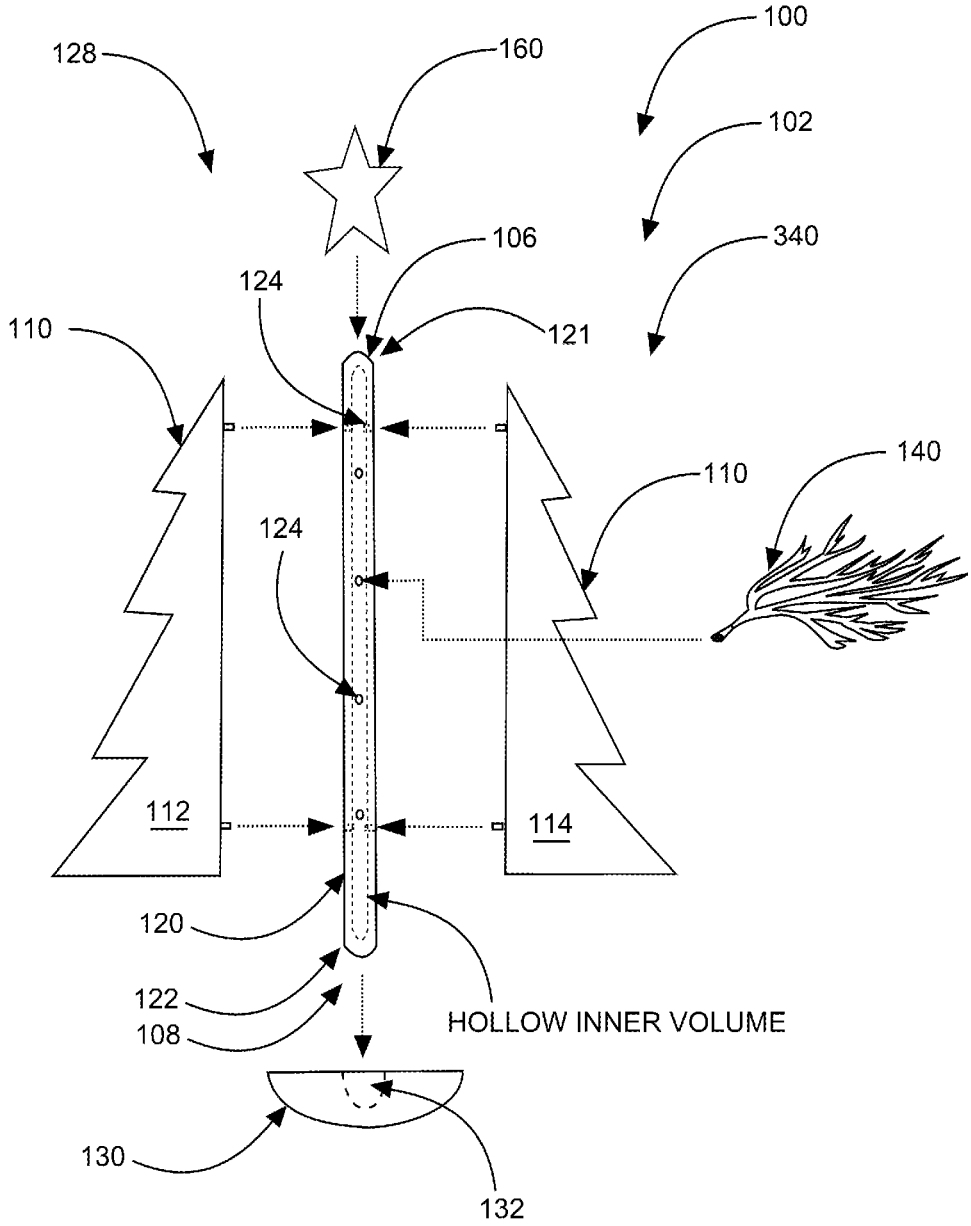
FIG. 2 is a perspective view illustrating an assembly of the Xtree system according to an embodiment of the present invention of FIG. 1.
Figure 3:
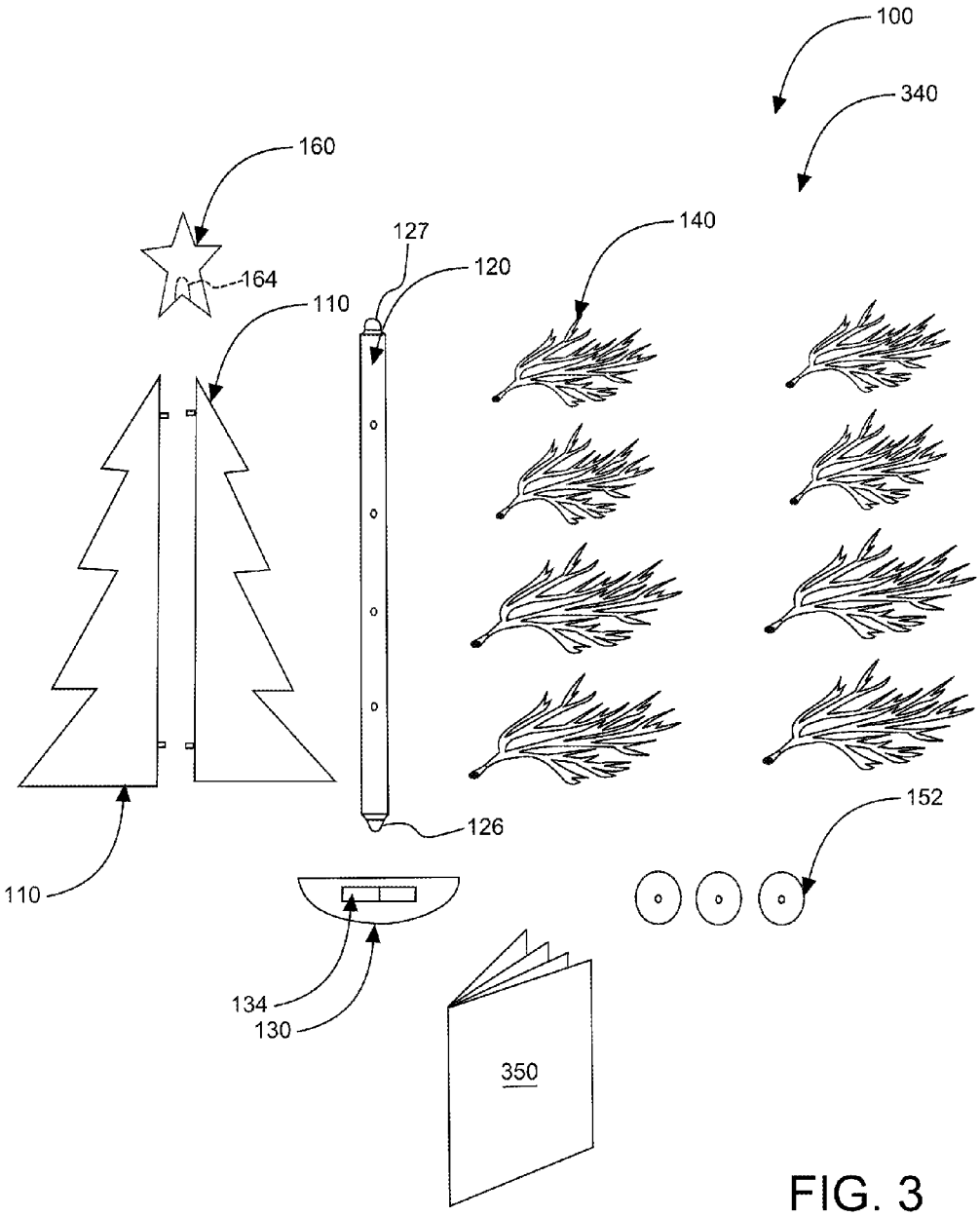
FIG. 3 is a perspective view illustrating components of the Xtree system according to an embodiment of the present invention of FIG. 1.

Referring now to FIGS. 2 and 3, showing perspective views illustrating the assemblage of components of xtree system 100 according to an embodiment of the present invention of FIG. 1. Xtree systems 100 preferably comprises at least two flat tree half outlines 110, spine 120 having plurality of sockets 124, base 130 having (DC) electrical powering means, and a plurality of insertable branches 140. When these components are assembled to create xtree system 100, as shown in FIG. 3, xtree system 100 may be wall-mountable on vertical surface 150.

Flat tree outlines 110 include first flat tree outline 112 and second tree outline 114. Flat tree outlines 110 comprise a lightweight material such as fiberglass or Styrofoam materials. Flat tree outlines 110 may be embedded with computer-controlled lights, and include hanging means for ornaments to be hung therefrom. As shown in FIG. 2, flat tree outlines 110 may be one of two components used to construct frame 128 for wall-mounted Christmas tree device 102 of xtree system 100. Another component is spine 120 having a plurality of sockets 124. When wall-mounted Christmas tree device 102 is removably assembled, first flat tree outline 112 and second tree outline 114 are removably insertable into sockets 124 of spine 120 to form frame 128 of wall-mounted Christmas tree device 102.

When wall-mounted Christmas tree device 102 is removable mounted onto or to vertical surface 150, the plurality of attachers 152 may be used to temporarily secure wall-mounted Christmas tree device 102 onto vertical surface 150. When wall-mounted Christmas tree device 102 is removably attached onto vertical surfaces 150 such as a reflective surface, attachers 152 suction cups or other suitable fastening means may be used. Within this disclosure reflective surface may be defined as a mirror, glass, or a window. When wall-mounted Christmas tree device 102 is removably attached onto other vertical surfaces 150 such as a wall or door, attachers 152 double-sided tape may be used as attaching means.

Upon reading this specification, it should be appreciated that, under appropriate circumstances, considering such issues as user preferences, design preference, structural requirements, marketing preferences, cost, available materials, technological advances, etc., other attachers for removably attaching wall-mounted Christmas tree device 102 to vertical surfaces 150, such as putty, clips, hangers, nails, etc., may also be sufficient.

To assemble frame 128, flat tree half outlines 110 are removably insertable into sockets 124 of spine 120 as stated previously. Spine 120 is preferably comprises a hollow inner-volume to permit a non-obstructive path for the electrical wiring to flow in xtree system 100 starting at base 130 and continuing upwardly as a supply/communication means to provide power to the extremities of the present invention. Spine 120 preferably comprises plastic, but other materials such as wood may be used. Sockets 124 are preferably used for the removably attaching of both flat tree outlines 110 and branches 140.

Further, at top portion 121 of spine 120 is top-mounted removably couplable decorative adornment 160 while at bottom 122 of spine 120 is base 130. Decorative adornment preferably comprises female adapter 164. Decorative adornment 160 preferably comprises a star. Alternatively, decorative adornment 160 comprises an angel or other suitable decorative ornamentation(s). Upon reading this specification, it should be appreciated that, under appropriate circumstances, considering such issues as user preferences, design preference, structural requirements, marketing preferences, cost, available materials, technological advances, etc., other decorative adornments such as, for example, lights, a foil coated tinsels or members, plastic/glass ornaments, etc., may be sufficient.

In an alternate embodiment, wall-mounted Christmas tree device 102 may not include flat tree outlines 110. In this embodiment, spine 120 may have a plurality of spines, preferably two coupled together to act as a hinging mechanism for when flat tree outlines 110 are used. In this way, if flat tree outlines 110 are included, due to the hinging mechanism, frame 128 may be pre-constructed prior to purchasing xtree system 100 in that flat tree outlines 110 may be coupled to spine 120. In this embodiment, due to the spine being hinged, the plurality of spines 120 may be folded in half vertically and packaged. The benefit of this hinged mechanism is that users may store either version of the device in its original packaging between uses.

Base 130 preferably has electrical powering means to power branches 140 and decorative adornment 160. Further, base 130 is removably coupleable to spine 120 via a temporary locking mechanism to power wall-mounted Christmas tree device 102. Base 130 preferably has female adapter 132 located at a top region of base 130. Spine 120 comprises first male adapter 126 and second male adapter 127 both located on the ends of spine 120. Female adapter 132 on base 130 is removably coupleable to spine 120 via first male adapter 126. Second male adapter 127 on spine 120 is removably coupleable to female adapter 164 on decorative adornment 160. Additionally, base 130 houses a computing and communication means suitable for controlling lighting patterns, and music.

For electrically powering wall-mounted Christmas tree device 102 including decorative adornment 160 and branches 140, wiring may be concealably run up from base 130 through hollow inner volume spine 120 to decorative adornment 160 thereby creating a substantially enclosed circuit. The electrical powering means from base 130 may comprises a Direct Current (DC) power or unidirectional flow of electric charge. The DC power source preferably comprises at least one battery. Furthermore, wall-mounted Christmas tree device 102 may have electrical powering means comprising an AC power source.

For the temporary control of lighting patterns and music, base 130 of wall-mounted Christmas tree device 102 comprises front-access panel 134 allowing users to select the lighting patterns and the music. Front-access panel 134 includes buttons and/or switches to regulate the duration and activation/deactivation of the lighting. Additionally, front-access panel 134 permits the user to choose which songs from a selectable group they would like to hear. Further, front-access panel 134 allows the user decide when and how the music is to be played.

For wall-mounted Christmas tree device 102 to generate a 3-dimensional effect thereby providing a suitable ornamental holiday decoration, plurality of branches 140 are removably insertable and arrangeable in sockets 124 of spine 120. Branches 140 are preferably bendable and manipulatable to suit the look desired by the user. Branches 140 comprise computer-controlled light-emitting diodes. Further, branches 140 preferably comprise pre-fitted decorations including ornaments, ribbons, bells, and/or candy. The amount of branches 140 wall-mounted Christmas tree device 102 possess is up to the user as to how full they prefer xtree system 100 to appear.

Xtree system 100 according to an embodiment of the present invention of FIGS. 1-3 may comprise kit 340. Kit 340 may comprise the following parts: at least two flat tree half outlines 110; at least one spine 120 having a plurality of sockets 124; at least one decorative adornment 160; base 130 having electrical powering means; a plurality of insertable branches 140; attaching means; and a set of user instructions 350. Kit 340 may be manufactured and provided for sale in a wide variety of sizes and shapes for a wide assortment of applications. Further, the various components may be interchangeable between kits 340.

Upon reading this specification, it should be appreciated that, under appropriate circumstances, considering such issues as user preferences, design preference, structural requirements, marketing preferences, cost, available materials, technological advances, etc., other exercising methods and motions may be performed with the present invention as well as other configurations may be possible, etc., may be sufficient.

Figure 4:
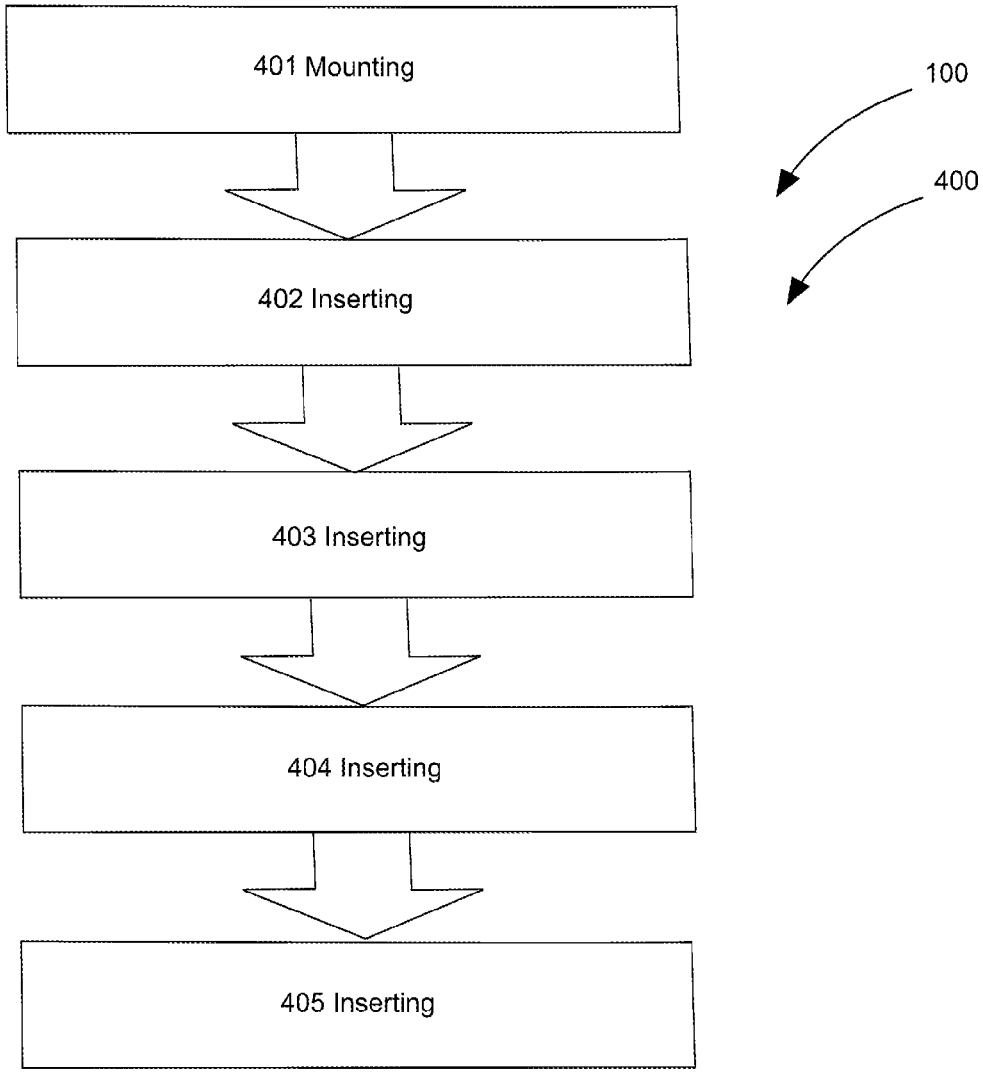
FIG. 4. is a flowchart illustrating a method of use according to an embodiment of the present invention of FIGS. 1-3.

Referring now to FIG. 4 showing flowchart 450 illustrating a method of use 400 according to an embodiment of the present invention of FIGS. 1-3.

In accordance with the embodiments of the present invention a preferred method of use 400 is disclosed herein comprising: step one 401 (removably) mounting at least one spine 120 having a plurality of sockets 124 onto a vertical surface 150; step two 402 inserting at least two flat tree half outlines 110 into the plurality of sockets 124; step three 403 inserting decorative ornament(s) 160 into the plurality of sockets 124 on top portion 121 of spine 120; step four 404 inserting base 130 (having electrical powering means) or otherwise attaching to the plurality of sockets 124 on spine 120; and step five 405 inserting the plurality of insertable branches 140 into the plurality of sockets 124 on spine 120 for a 3-dimensional effect thereby providing a ornamental holiday decoration.

It should be noted that the steps described in method of use 400 can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain exercise or storing steps, including or excluding certain steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention.

What is claimed is new and desired to be protected by Letters Patent is set forth in the appended claims:

1. A wall-mounted Christmas tree device comprising:

a) at least two polystyrene foam or fiberglass flat tree half outlines including double-sided tape or a plurality of suction cups to removably attach said wall-mounted Christmas tree device on a vertical surface including;

b) a plastic spine having a hollow inner volume and a plurality of sockets, and a top-mounted removably couplable decorative adornment;

c) a base having electrical powering means comprising a DC power source including at least one battery, or an AC power source, a computing means suitable for controlling lighting patterns and music, and a front-access panel allowing users to select said lighting patterns and said music; and d) a plurality of insertable branches having computer-controlled light-emitting diodes and pre-fitted decorations including ornaments, ribbons, bells, and/or candy;

e) wherein said at least two flat tree half outlines are removably insertable into said sockets of said spine to form a frame for said wall-mounted Christmas tree device;

f) wherein said spine is removably coupleable to said base to power said wall-mounted Christmas tree device;

g) wherein said plurality of branches are removably insertable and arrangeable in said sockets in said spine for a 3-dimensional effect thereby providing an ornamental holiday decoration.

2. The wall-mounted Christmas tree device of claim 1 further comprising a kit including: said at least two flat tree half outlines; said at least one spine having a plurality of sockets; at least one said top-mounted removably couplable decorative adornment; said base having electrical powering means; said plurality of insertable branches; attaching means; and a set of user instructions.

3. The wall-mounted Christmas tree device of claim 1 wherein said top-mounted removably couplable decorative adornment is a star.

4. The wall-mounted Christmas tree device of claim 1 wherein said top-mounted removably couplable decorative adornment is an angel.

* * * * *